US005309870A

United States Patent [19]

Ap

[11] Patent Number: 5,309,870

[45] Date of Patent: May 10, 1994

[54] METHOD AND APPARATUS FOR COOLING A HEAT ENGINE OF WIDELY VARIABLE POWER

[75] Inventor: Ngy S. Ap, Villepinte, France

[73] Assignee: Valeo Thermique Moteur, Le Mesni-Saint-Denis, France

[21] Appl. No.: 986,138

[22] Filed: Dec. 4, 1992

[30] Foreign Application Priority Data

Dec. 6, 1991 [FR] France ..... 91 .15173

[51] Int. Cl.[5] ..... F01P 9/02

[52] U.S. Cl. ..... 123/41.21; 123/41.1

[58] Field of Search ..... 123/41.1, 41.2, 41.21, 123/41.33, 41.44

[56] References Cited

U.S. PATENT DOCUMENTS

| | | | |
|---|---|---|---|
| 1,767,598 | 6/1930 | Mallory et al. . | |
| 4,550,694 | 11/1985 | Evans | 123/41.02 |
| 4,649,869 | 3/1987 | Hayashi et al. | 123/41.44 |
| 4,658,765 | 4/1987 | Hayashi | 123/41.21 |
| 4,768,484 | 9/1988 | Scarselletta | 123/41.21 |
| 4,932,365 | 6/1990 | Marshall et al. | 123/41.05 |

FOREIGN PATENT DOCUMENTS

| | | |
|---|---|---|
| 0207354 | 1/1987 | European Pat. Off. . |
| 3809136 | 10/1988 | Fed. Rep. of Germany . |

*Primary Examiner*—Noah P. Kamen

*Attorney, Agent, or Firm*—Morgan & Finnegan

[57] ABSTRACT

A cooling system for a motor vehicle engine includes a heat exchanger, ducting connecting the engine and the heat exchanger in a closed circuit, and a pump for circulating coolant fluid in the circuit. The heat exchanger is arranged to act as a condenser when required, and the pump is an electric pump which circulates the coolant fluid between the engine and the heat exchanger. The system includes a three-way thermostatic valve, which causes the fraction of the cooling fluid delivered into the heat exchanger, in relation to the constant flow passing through the engine, to be varied progressively from 0 to 100%. When the engine is working at its highest power, the fluid vaporises in the engine and condenses in the heat exchanger, while at lower power levels the heat exchanger operates like a conventional cooling radiator.

10 Claims, 3 Drawing Sheets

METHOD AND APPARATUS FOR COOLING A HEAT ENGINE OF WIDELY VARIABLE POWER

FIELD OF THE INVENTION

This invention relates to cooling systems for heat engines, such as internal combustion engines, capable of operating at widely varying power levels, and in particular motor vehicle engines; and is concerned with methods of achieving such cooling and apparatus for performing such methods.

BACKGROUND OF THE INVENTION

A common method of cooling the internal combustion engine of a motor vehicle consists in causing a coolant fluid, such as water or an aqueous solution of an antifreeze preparation, to flow between the engine and a heat exchanger so that the engine yields heat to the fluid, which then yields the heat in the heat exchanger to an external environment, which is generally a stream of atmospheric air.

It is usual to maintain the fluid under pressure, so that it remains in practice in the liquid state regardless of the power level at which the engine is operating, and therefore regardless also of the rate of transfer of the heat to be evacuated from the system. Circulation of the fluid is provided by means of a pump which is driven mechanically by the engine of the vehicle. The output of the pump is therefore proportional to the speed at which the engine is operating. At high engine speeds, the circulating pump works at a high mechanical power which may reach 1 or 2 kilowatts. In addition, the relative pressure of the fluid reaches about 0.8 to 1.2 bar, which makes it more difficult to obtain lasting sealing of the cooling circuit.

DISCUSSION OF THE INVENTION

The object of the invention is to overcome the above mentioned drawbacks.

According to the invention in a first aspect, a method of cooling a heat engine of widely variable power, wherein a coolant fluid is caused to flow between the said engine, which yields heat to it, and a heat exchanger in which it yields heat to an external environment, is characterised in that the fluid is introduced into the engine in the liquid state at a volumetric flow rate which is substantially independent of the power and running mode of the engine, with the fluid arriving at the heat exchanger entirely in the liquid state when the engine is running at low power, and at least partly in the gaseous state when the engine is running at high power.

The constant output obtained by this method may be achieved for example using a small electric pump having a power output in the range between 30 and 100 watts.

The coolant fluid is preferably circulated under atmospheric pressure.

According to a preferred feature of the invention, when the coolant fluid arrives at the heat exchanger entirely in the liquid state, a fraction of the flow, variable as a function of power, passes through the heat exchanger; and when, by contrast, the coolant fluid arrives at the heat exchanger at least partly in the gaseous state, all of the flow passes through the heat exchanger. This is preferably achieved by sensing the temperature of the fluid at a predetermined point in the cooling circuit, and using this information to determine the fraction of the fluid flow which is to be delivered to the heat exchanger.

According to the invention in a second aspect, an apparatus for cooling a heat engine of widely varying power, by a method according to the said first aspect of the invention, comprises a heat exchanger for extracting heat from the coolant fluid and adapted to enable fluid arriving in the gaseous state to become condensed, an electric pump for causing the fluid to flow between the engine and the heat exchanger, an expansion chamber which is adapted to accumulate a variable volume of fluid in the liquid state and in the gaseous state, and ducts for the fluid, the said ducts connecting together the engine, the heat exchanger, the pump and the expansion chamber.

Preferably, the apparatus further includes a thermostatic valve having at least three ways and adapted to cause the fraction of the flow of fluid delivered into the heat exchanger to be varied as a function of the temperature of the fluid which passes through it.

In a preferred form of apparatus according to the invention, the thermostatic valve is adapted to be regulated between a first extreme position corresponding to a zero fluid flow into the heat exchanger, which is achieved at a fluid temperature lower than the normal operating temperature range, especially during cold starting of the engine, and a second extreme position corresponding to a 100% flow into the heat exchanger, which is achieved at a fluid temperature close to its boiling point.

Preferably then, the ducts for the fluid comprise: an outlet duct of the engine extending from the engine to the heat exchanger; a return duct extending from the heat exchanger to the thermostatic valve; an inlet duct of the engine extending from the thermostatic valve to the engine; and a bleed duct extending from the outlet duct to the thermostatic valve, with the latter being arranged to obturate the return duct when in its first extreme position and the bleed duct when in its second extreme position, and the electric pump being mounted in the inlet duct of the engine.

In addition, all or some of the following fluid ducts may be provided:

a first degassing duct leading from an outlet chamber of the heat exchanger to the expansion chamber and arranged at a higher level than the latter;

a first compensating duct leading from a lower region of the expansion chamber, the lower region being arranged so that it is always filled with coolant fluid in the liquid state, to the return duct;

a second degassing duct leading from the engine inlet duct to an auxiliary reservoir, which lies at a lower level than the expansion chamber and which is connected to the latter through a further valve, which is adapted to allow air to pass from the auxiliary reservoir to the expansion chamber but to prevent liquid from passing between the auxiliary reservoir and the expansion chamber, the second degassing duct being arranged at a higher level than the engine inlet duct;

a second compensating duct leading from the auxiliary reservoir and terminating at the engine inlet duct through a terminal portion of the second compensating duct lying at a lower level than the engine inlet duct;

an oil cooler inlet duct leading from the engine outlet duct downstream of the point at which the bleed duct is connected to the latter, the oil cooler inlet duct being arranged at a lower level than the engine outlet duct and leading to an oil cooler in which the engine lubricating oil is cooled by the coolant fluid; and an oil cooler outlet duct leading from the oil cooler to the heat exchanger.

These and other features and advantages of the invention will appear more clearly from the detailed description which is given below, of a preferred embodiment of the invention. The description is given by way of example only and with reference to the accompanying drawings.

DESCRIPTION OF A PREFERRED EMBODIMENT OF THE INVENTION

Figure 1:
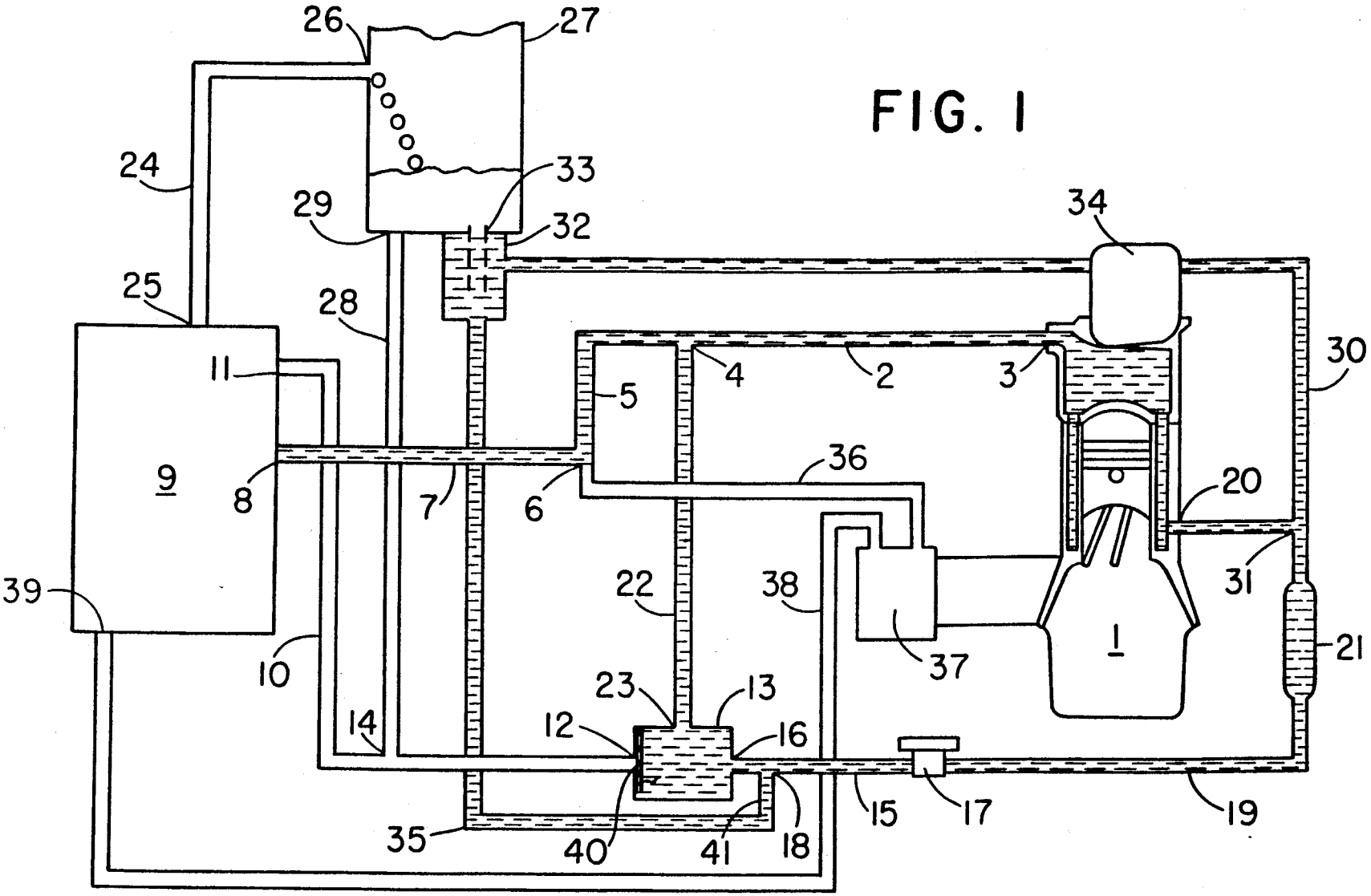
FIGS. 1 to 3 are diagrammatic illustrations of a cooling apparatus in accordance with the invention, with each Figure showing the apparatus in a different state of operation.

The apparatus shown in the drawings is a cooling system for the internal combustion engine 1 of a motor vehicle. It includes an engine outlet duct through which an engine coolant fluid leaves the engine. This outlet duct comprises a first section 2 extending from an outlet port 3 of the engine to a junction point 4 at which the first section 2 joins a second section 5. The second section 5 of the engine outlet duct extends from the junction point 4 to a further junction point 6 situated at a lower level than the former. Finally, the engine outlet duct has a third section 7 which extends from the junction point 6 to an inlet port 8 of a heat exchanger 9. In the drawings, the latter is shown diagrammatically in the form of a simple rectangle. A return duct 10 extends between the outlet port 11 of the heat exchanger 9 and an inlet port 12 of a three-way thermostatic valve 13. The return duct includes an intermediate junction point 14 lying in the lowest part of the duct.

The engine 1 also has an engine coolant inlet duct, which comprises a first section 15 extending from an outlet port 16 of the valve 13 to an electric circulating pump 17. The first section 15 includes an intermediate junction point 18. The engine inlet duct also includes a second section 19 which extends from the pump 17 to an inlet port 20 of the engine. A radiator 21 for heating the cabin of the vehicle is mounted on the second section 19.

A bleed duct 22 extends between the junction point 4 and a second input port 23 of the thermostatic valve 13. The port 23 is situated at a lower level than the junction point 4. A first degassing duct 24 extends from a degassing port 25, which is open into the same outlet chamber (not shown) of the heat exchanger 9 as the outlet port 11. The degassing duct 24 terminates at an inlet aperture 25 of an expansion chamber 27, the aperture 26 being arranged at a certain height above the base of the expansion chamber 27.

The expansion chamber, only part of which is shown in the drawings, is provided for the purpose of receiving a volume of coolant fluid which is extremely variable by virtue of the change of state of the fluid. To this end, the expansion chamber may for example have a deformable wall which enables its internal volume to vary. A compensating duct 28 extends between an aperture 29 which is formed in the base of the expansion chamber 27, and the junction point 14, the compensating duct being arranged entirely at a lower level than the expansion chamber, and at a higher level than the junction point 14.

A second degassing duct 30 extends from a junction point 31, which is situated on the engine inlet duct 19 between the heating radiator 21 and the inlet port 20 of the engine. This degassing duct 30 terminates in an auxiliary reservoir 32 which is mounted below the base of the expansion chamber 27, with which it communicates through a valve 33. The valve 33 is arranged to allow air to pass from the auxiliary reservoir 32 into the expansion chamber 27, but to prevent the passage of fluid in the liquid state between the reservoir 32 and the chamber 27.

The auxiliary reservoir 32 and the valve 33 are typically of the kind described in the specification of French published patent application No. FR 2 640 364A, to which reference is invited for further details of their structure and method of operation.

The whole of the second degassing duct 30 lies above the level of the junction point 31. A heat transfer device 34 is mounted in the degassing duct 30, for the purpose of transferring heat from the coolant fluid flowing in the duct 30 to the combustible mixture in the engine, so as to raise the temperature of the latter after it has been injected into the cylinders of the engine 1. A second compensating duct 35 connects the auxiliary reservoir 32 to the junction point 18 of the duct 15, and has a terminal region 41 connected to the junction point 18 and lying below the level of the latter.

An oil cooler inlet duct 36 extends from the junction point 6, and lies entirely below the level of the latter. The oil cooler inlet duct 36 terminates in a heat exchanger 37 for transferring heat from the lubricating oil of the engine 1 to the coolant fluid. The heat exchanger 37 is generally referred to simply as an oil cooler. Finally, an outlet duct 38 from the oil cooler 37 is connected to a second inlet port 39 of the heat exchanger 9.

Figure 3:
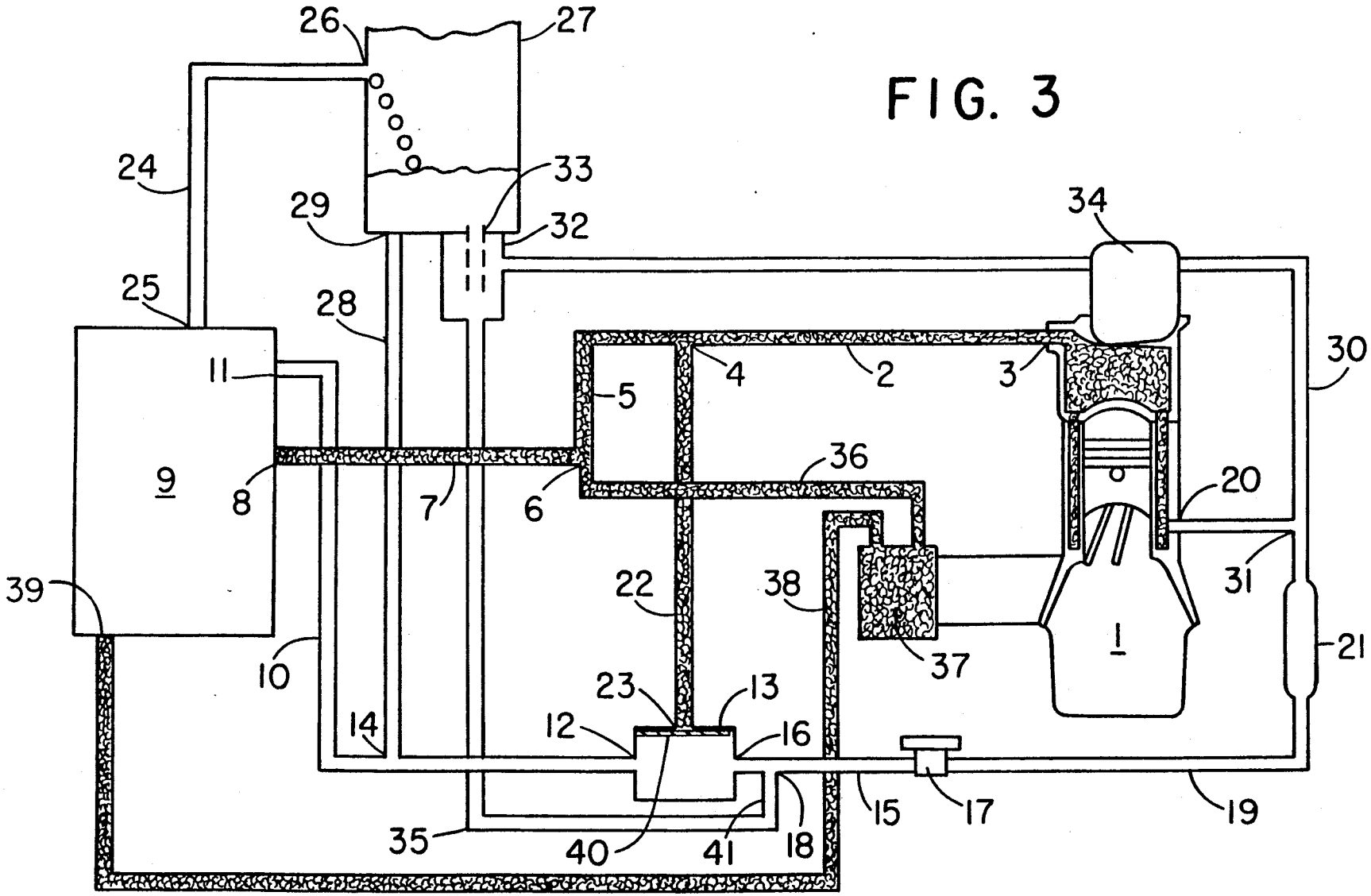

The thermostatic valve 13 includes a movable element or valve member 40, which is indicated in the drawings (by way of example only) in the form of a pivoting flap, and which is arranged to be displaced between a first extreme position seen in FIG. 1 and a second extreme position shown in FIG. 3. In the first position (FIG. 1) the valve member 40 covers the first inlet port 12 of the valve, while in its FIG. 3 position it covers the second inlet port 23. The valve member 40 is displaced as a function of the temperature of the fluid present within the valve: the FIG. 1 position is reached at a temperature lower than the range of temperatures prevailing during normal operation, while the FIG. 3 position is reached at a temperature which is equal to, or slightly lower than, the boiling point of the coolant fluid.

FIG. 1 shows the operation of the apparatus during cold starting of the engine 1, when the temperature of the coolant fluid leaving the engine has not yet reached the threshold temperature at which the first inlet port 12 of the thermostatic valve is allowed to be open. No fluid therefore flows either in the heat exchanger 9 or in the ducts 5, 7, 10, 36 and 38. All of the coolant fluid flowing in the engine 1, at a flow rate which is determined by the pump 17, passes through the bleed duct 22 and enters the thermostatic valve 13 through its second inlet port 23. Degassing of this fluid is effected entirely via the duct 30 and the auxiliary reservoir 32, the volume of air evacuated being compensated for by an equal volume of liquid passing from the reservoir 32, via the duct 35, into the duct 15.

Figure 2:
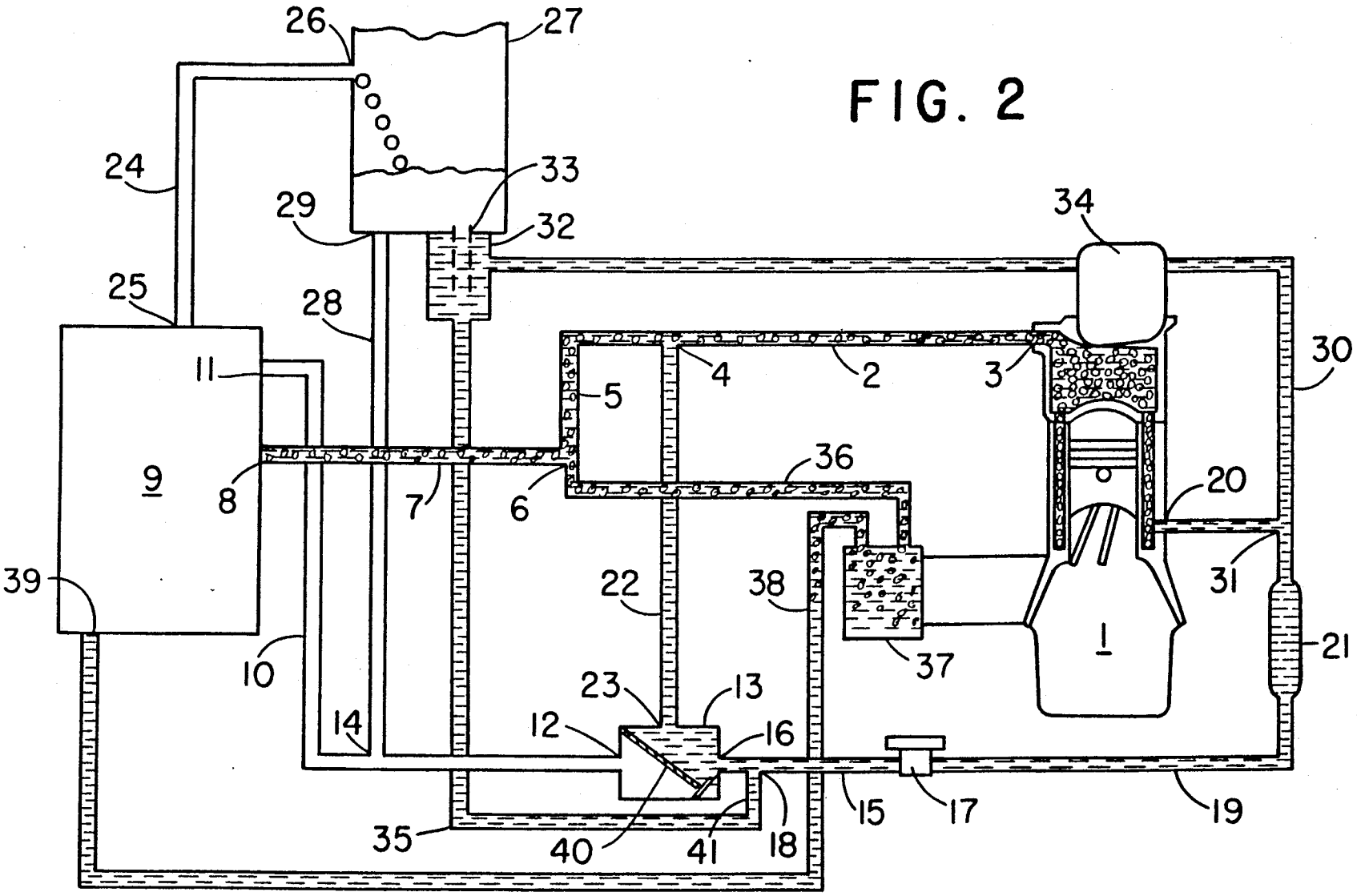

FIG. 2 illustrates the normal operation of the engine at low or medium power. The temperature of the fluid arriving in the thermostatic valve 13 via the second inlet port 23 is higher than the lower threshold mentioned above, and the valve member 40 is in a position such that the first valve inlet port 12 is open, so that some of the fluid is enabled to flow through the heat exchanger 9. This fraction of the total fluid flow passes through the duct section 5, and is then sub-divided into a first sub-fraction which passes into the heat exchanger 9 through the duct section 7 and the inlet port 8, and a second sub-fraction which passes through the duct 36, the oil cooler 37 and the duct 38, to enter the heat exchanger 9 through the second inlet port 39 of the latter.

These two sub-fractions are re-joined inside the heat exchanger 9, and the fraction thus reconstituted leaves the heat exchanger via its outlet port 11, passing then to the thermostatic valve via the duct 10 and inlet port 12. The other, complementary, fraction of the fluid passes through the bleed duct 22 and the second inlet port 23 of the thermostatic valve in the manner described above.

Any air that may be present in the heat exchanger 9 collects in the upper part of the outlet chamber of the latter, from which it escapes through the degassing port 25, to pass via the duct 24 and inlet aperture 26 into the expansion chamber 27. A corresponding volume of fluid in the liquid state is delivered into the duct 10 through the duct 28. A small part of the fluid may become vaporised in the engine, but this will condense before it reaches the heat exchanger 9 and thermostatic valve 13.

When the engine is working at higher power levels, the fluid becomes vaporised at least partly within the engine, and arrives in a partly gaseous state at the heat exchanger 9, which then acts as a condenser. The condensed fluid, which leaves the heat exchanger through the outlet port 11 and is passed from the latter through the duct 10 to the thermostatic valve, is in addition at a temperature which is close to the boiling point. Accordingly, the movable valve member 40 is arranged to cover the second valve inlet port 23. All of the fluid delivered by the pump 17 will then pass through the heat exchanger 9, which therefore removes a maximum amount of heat.

This rate of heat transfer in the heat exchanger can of course be increased even more, in a known way, by the use of a suitable fan or blower (not shown), delivering a stream of air through the heat exchanger 9 and controlled by a thermostatic interruptor as a function of the temperature of the fluid in the outlet chamber of the heat exchanger.

The apparatus described above may be modified by arranging the thermostatic valve ahead of the heat exchanger, between the outlet port and the inlet port of the engine. The bleed duct then connects the thermostatic valve to the engine inlet duct.

What is claimed is:

1. A method of cooling an internal combustion engine of widely variable power, in which a coolant fluid flows between the engine and a heat exchanger whereby the engine yields heat to the fluid and the fluid then yields heat in the heat exchanger to an external environment, the method comprising the steps of introducing the fluid into the engine in the liquid state at a volumetric flow rate which is substantially independent of the power and working mode of the engine, whereby when the engine is running at low power the fluid reaches the heat exchanger entirely in the liquid state, and when the engine is running at high power the fluid reaches the heat exchanger at least partly in the gaseous state, causing a fraction of the fluid flow, variable according to the power output of the engine, when the coolant fluid reaches the heat exchanger entirely in the liquid state, to pass through the heat exchanger, and causing all of the fluid flow to pass through the heat exchanger when the coolant fluid reaches the heat exchanger at least partly in the gaseous state.

2. A method according to claim 1, wherein the coolant fluid flows at atmospheric pressure.

3. A method of cooling an internal combustion engine of widely variable power in which a coolant fluid flows between the engine and a heat exchanger whereby the engine yields heat to the fluid and the fluid then yields heat in the heat exchanger to an external environment, the method comprising the steps of introducing the fluid into the engine in the liquid state at a volumetric flow rate which is substantially independent of the power and working mode of the engine, whereby when the engine is running at low power the fluid reaches the heat exchanger entirely in the liquid state, and when the engine is running at high power the fluid reaches the heat exchanger at least partly in the gaseous state, causing a fraction of the fluid flow, variable according to the power output of the engine, when the coolant fluid reaches the heat exchanger entirely in the liquid state, to pass through the heat exchanger, and causing all of the fluid flow to pass through the heat exchanger when the coolant fluid reaches the heat exchanger atleast partly in the gaseous state, sensing the fluid temperature at a predetermined point in the cooling circuit, and using this information thereby to determine the appropriate fraction of the flow to be delivered to the heat exchanger.

4. Apparatus for cooling the coolant fluid of an internal combustion engine of widely variable power comprising a heat exchanger for removing heat from the coolant fluid and adapted to enable fluid entering the heat exchanger in the gaseous state to condense therein; a pump for causing the fluid to flow between the engine and the heat exchanger in the liquid state at a volumetric flow rate which is substantially independent of the power and working mode of the engine, whereby when the engine is running at low power the fluid reaches the heat exchanger entirely in the liquid state, and when the engine is running at high power the fluid reaches the heat exchanger at least partly in the gaseous state; an expansion chamber for accumulating a variable volume of fluid in the liquid state and in the gaseous state; and duct means for connecting the engine, the heat exchanger, the pump and the expansion chamber to cool the engine; a thermostatic valve in selective fluid communication with the engine, the pump and the heat exchanger at least three ways, for varying the fraction of the fluid flow delivered to the heat exchanger according to the temperature of the fluid passing through the valve.

5. Apparatus according to claim 4, wherein the thermostatic valve defines a first extreme position and the second extreme position thereof, the apparatus further including means for adjusting the position of the valve between the first position and the second position, whereby, when the fluid temperature is below a predetermined normal operating temperature range, the valve is in the first position to deliver zero flow to the heat exchanger, and when the fluid temperature is close to its boiling point the valve is in the second extreme position delivering the entire flow to the heat exchanger.

6. Apparatus according to claim 5, wherein the duct means include: an engine outlet duct connected between the engine and the heat exchanger; a return duct leading from the heat exchanger to the thermostatic valve; an engine inlet duct leading from the thermostatic valve to the engine, the pump being in fluid communication in the engine inlet duct; and a bleed duct leading from the outlet duct to the thermostatic valve, whereby the thermostatic valve obturates the return duct in its first extreme position and the bleed duct in its second extreme position.

7. Apparatus according to claim 6, in which the heat exchanger includes an outlet chamber, the expansion chamber having a lower region thereof to be always filled with coolant fluid in the liquid state, wherein the apparatus further includes an auxiliary reservoir coupled to the expansion chamber and disposed at a lower level than the expansion chamber, and a further valve connecting the expansion chamber to the auxiliary reservoir to allow air to pass from the auxiliary reservoir into the expansion chamber and to prevent liquid from passing between the expansion chamber and the auxiliary reservoir, and wherein the duct means have a first degassing duct leading from the outlet chamber of the heat exchanger to the expansion chamber, the first degassing duct being arranged at a higher level than the outlet chamber; a first compensating duct leading from the lower region of the expansion chamber to the return duct; a second degassing duct leading from the engine inlet duct to the auxiliary reservoir, the second degassing duct being at a higher level than the engine inlet duct; and a second compensating duct leading from the auxiliary reservoir to the engine inlet duct, the second compensating duct having a terminal portion joined to the engine inlet duct at a lower level than the engine inlet duct.

8. Apparatus according to claim 6, wherein the engine outlet duct has a junction point at which the bleed duct is connected to the engine outlet duct, the apparatus further including an oil cooler for cooling engine lubricating oil by heat transfer from the lubricating oil to the coolant fluid therein, the duct means further including an oil cooler inlet duct leading from the engine outlet duct to the oil cooler, the oil cooler inlet duct being disposed at a lower level than the engine outlet duct and being connected to the engine outlet duct downstream of the junction point of the bleed duct; and an oil cooler outlet duct leading from the oil cooler to the heat exchanger.

9. Apparatus according to claim 5, wherein the duct means comprise: an engine outlet duct leading from the engine to the thermostatic valve; a connecting duct leading from the thermostatic valve to the heat exchanger; an engine inlet duct leading from the heat exchanger to the engine; and a bleed duct leading from the thermostatic valve to the inlet duct, whereby the thermostatic valve obturates the connecting duct when in its first extreme position and the bleed duct when in its second extreme position, the pump being mounted in the engine inlet duct.

10. Apparatus according to claim 4, wherein the pump further comprises an electric pump.

* * * * *